US009050729B2

(12) United States Patent
Hao et al.

(10) Patent No.: US 9,050,729 B2
(45) **Date of Patent: *Jun. 9, 2015**

(54) SELF LOADING UTILITY KNIFE

(76) Inventors: Wen Hao, City of Industry, CA (US); Huang Yuan De, Yangjiang (CN)

( * ) Notice: Subject to any disclaimer, the term of this patent is extended or adjusted under 35 U.S.C. 154(b) by 549 days.

This patent is subject to a terminal disclaimer.

(21) Appl. No.: 12/773,283

(22) Filed: May 4, 2010

(65) Prior Publication Data

US 2010/0281696 A1 Nov. 11, 2010

Related U.S. Application Data

(60) Provisional application No. 61/175,234, filed on May 4, 2009.

(51) Int. Cl.
*B26B 5/00* (2006.01)

(52) U.S. Cl.
CPC ..... *B26B 5/001* (2013.01)

(58) Field of Classification Search
CPC ..... B26B 5/001; B26B 5/08
USPC ..... 30/162, 164, 329, 335, 337
See application file for complete search history.

(56) References Cited

U.S. PATENT DOCUMENTS

| | | | | |
|---|---|---|---|---|
| 2,172,072 | A * | 9/1939 | Rothschild | 30/158 |
| 3,660,895 | A * | 5/1972 | West | 30/162 |
| 3,660,896 | A * | 5/1972 | Umholtz | 30/162 |
| 4,517,741 | A * | 5/1985 | Castelluzzo | 30/162 |
| 6,415,514 | B1 * | 7/2002 | Chun | 30/162 |
| 6,513,246 | B2 * | 2/2003 | Ping | 30/125 |
| 6,553,674 | B1 * | 4/2003 | Budrow | 30/162 |
| 6,742,260 | B1 * | 6/2004 | Hsu | 30/162 |
| 6,742,261 | B2 * | 6/2004 | Ho | 30/162 |
| 6,915,577 | B2 * | 7/2005 | Scala | 30/156 |
| 7,305,770 | B2 * | 12/2007 | Critelli et al. | 30/162 |
| 7,337,546 | B2 * | 3/2008 | Cheng | 30/156 |
| 7,418,784 | B2 * | 9/2008 | Fossella | 30/162 |

(Continued)

*Primary Examiner* — Ned Landrum
*Assistant Examiner* — Fernando Ayala
(74) *Attorney, Agent, or Firm* — Myron Greenspan Lackenbach Siegel LLP

(57) ABSTRACT

A self-loading utility knife including an elongate handle having an internal chamber defining an axis and at one end is flat aperture for the passage of an active blade. The flat aperture defines a cutting plane extending through said handle along the axis. A blade-holder is slidably mounted in the chamber for movements in directions along the axis and is adapted to secure a single active blade for movement through the aperture when the blade holder is in the extended position. A blade-holder release button is coupled to the blade holder and is slidingly movable relative to the handle to move blade holder between retracted and extended positions. The handle has a blade compartment which is open to the chamber and can receive a stack of spare blades when a cover to the compartment is opened and blades can be shifted transversely relative to the axis into the chamber. The blade holder is provided with a recess having a depth no greater than the thickness of one blade to allow at least a portion of a single blade to be received in a retaining relationship within the recess to cause an end-most blade in the stack to be received within said recess to follow the movements of the blade holder. A spring biases the blades in the blade compartment inwardly in the direction of the blade holder. A blade releasing disc on the blade holder selectively locks a blade to the blade holder when the blade holder is in the extended position. The blade holder only receives a single blade within the recess. A belt clip s provided on the compartment cover.

13 Claims, 5 Drawing Sheets

(56) References Cited

U.S. PATENT DOCUMENTS

| | | | | |
|---|---|---|---|---|
| 7,448,136 | B2 * | 11/2008 | Huang | 30/125 |
| 8,201,336 | B2 * | 6/2012 | De | 30/162 |
| 8,220,161 | B2 * | 7/2012 | Chang | 30/162 |
| 2003/0154605 | A1 * | 8/2003 | Chao | 30/162 |
| 2005/0193567 | A1 * | 9/2005 | Ho | 30/162 |
| 2005/0283983 | A1 * | 12/2005 | Huang | 30/162 |
| 2006/0242841 | A1 * | 11/2006 | Fossella | 30/162 |
| 2007/0220758 | A1 * | 9/2007 | Ho | 30/162 |
| 2007/0283570 | A1 * | 12/2007 | Huang | 30/162 |
| 2010/0180449 | A1 * | 7/2010 | van Deursen | 30/162 |
| 2010/0263214 | A1 * | 10/2010 | Robinson et al. | 30/156 |
| 2011/0041344 | A1 * | 2/2011 | De et al. | 30/162 |

* cited by examiner 32b
32
32e
32f
32f
42c
b
B
16d 42c
b
32a
54c
56
60
32a
12a
B
b 20
54
56
16a
26
22
70
66b
66d 24
20
54
66b
66d B
12a
20
54
66b
66d

SELF LOADING UTILITY KNIFE

RELATED APPLICATIONS

This application claims the priority benefit of U.S. Provisional Application No. 61/175,234 filed on May 4, 2009, which provisional application is hereby incorporated by reference in its entirety.

BACKGROUND OF THE INVENTION

1. Field of the Invention:

The present invention generally related to hand tools, and more specifically to a self loading utility knife with a quick and automatic blade re-loading mechanism.

2. Description of the Prior Art:

Conventional utility knives include fixed, foldable and retractable knives. They are generally used to cut paper, fabric, and leather. The Chinese Patent Application No. 93208241.6 (Publication Date: Jun. 22, 1994) disclosed "a retractable rope-cut utility knife", in which a blade stored in a handle is extended out step by step by moving a slider. However, it is not convenient to replace the blade. The Chinese Patent Application No. 03223149.0 (Publication Date: Dec. 24, 2003) disclosed "a combined utility knife". It is convenient to replace a blade by arranging the blade in a groove of the handle assembly and using a top cover in connection with a lock member. However, the following problems exist. The structure is complex. When replacing a blade, a user needs to release the lock member first and then rotate the top cover, which is complicated and inconvenient. The Chinese Patent Application No. 20042010202117.2 (Publication Date: Feb. 8, 2006) disclosed "a utility knife" in which a blade is arranged in a mounting groove of a handle assembly and a fixing hole is provided in the handle assembly. A bolt anchored in the fixing hole secures the blade. This utility knife is also disadvantageous because extra tools are used when the blade is replaced.

SUMMARY OF THE INVENTION

Accordingly, it is an object of the invention to provide a retractable utility knife that is self loading, that does not include the disadvantages inherent in prior art utility knives.

It is another object of the invention to provide a retractable self loading utility knife that is simple in construction and economical to manufacture.

It is still another object of the invention to provide a retractable self loading utility knife as in the previous objects which permits one handed operation for releasing a blade from the knife.

It is yet another object of the invention to provide a retractable self loading utility knife of the type under discussion that is easy and convenient to use.

It is a further object of the invention to provide a retractable self loading utility knife as suggested in the previous objects that is ergonomically configured to allow a blade to be released with the thumb of a user while the knife is being held in the same hand of the user.

It is still a further object of the invention to provide a self loading utility knife as in the previous objects that is easy to load with a supply of blades.

It is yet a further object of the invention to provide a utility knife the previous objects that includes a safety mechanism for preventing inadvertent movement of the carriage and, therefore, the blade mounted on it, to the extended operative and exposed position.

It is yet a further object of the invention to provide a utility knife that is self loading and includes an access panel to the blades storage compartment that also serves as a panel that is integrally formed with a spring clip for attaching the utility knife on a belt or the like.

It is an additional object of the invention to provide the utility knife as in the previous objects that provides a smooth operation, includes a quick release blade mechanism that is only accessible when the blade supporting carriage is in its extended position thereby concealing the blade release mechanism in the retracted position of the carriage so that the blade cannot be inadvertently released.

BRIEF DESCRIPTION OF THE DRAWINGS

Other objects and features of the present invention may become clear from the following description taken in conjunction with the preferred embodiments thereof with reference to the accompanying drawings, in which:

FIG. 2 (B) is similar to FIG. 2 (A) but showing the locked carriage moved to the extended position exposing the quick release blade mechanism;

FIG. 3 (B) is similar to FIG. 3 (A), but illustrating the manner in which the blade release disc is rotated to raise the tab 42*c* to clear the notch in the blade and the manner in which the blade is released;

DESCRIPTION OF PREFERRED EMBODIMENT

Figure 1:
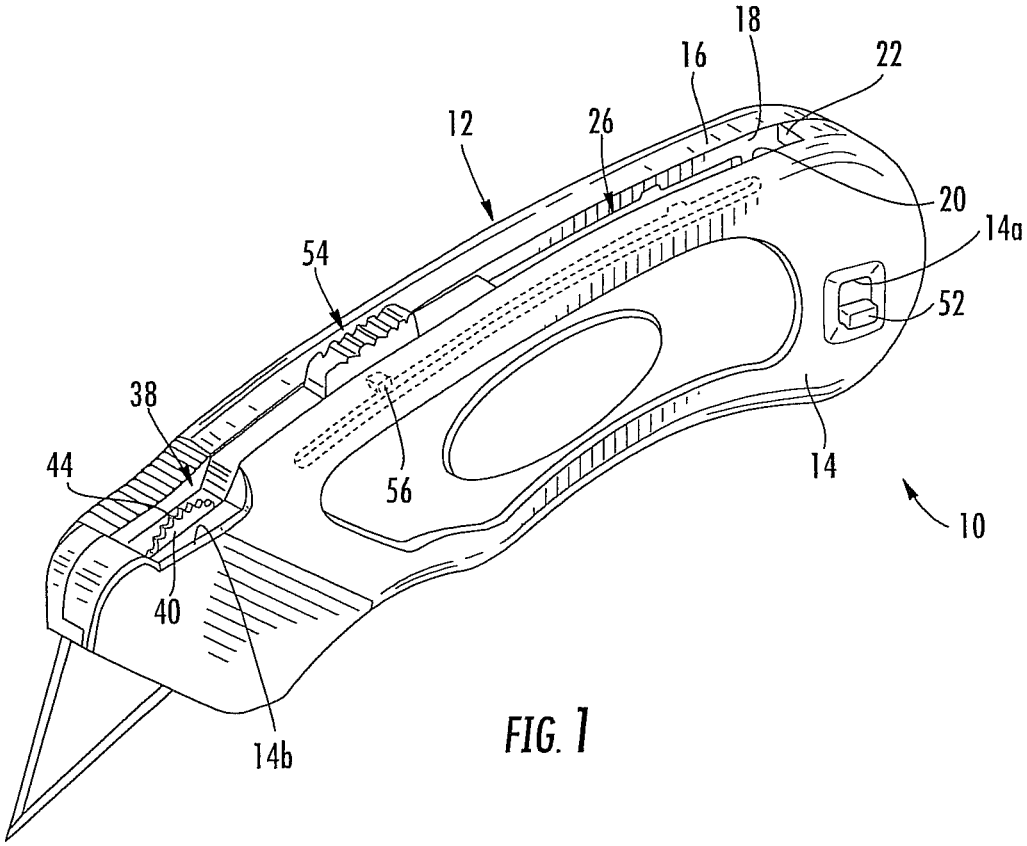
FIG. 1 is a front perspective view of the self loading utility knife in accordance with the invention, showing the blade-supporting carriage in its forward extended position to expose the blade as during its normal use.

Referring now specifically to the Figures in which identical or similar parts as designated by the same reference numerals throughout, and first referring to FIG. 1, the self loading utility knife in accordance with the present invention is generally designated by the reference numeral 10.

Figure 4:
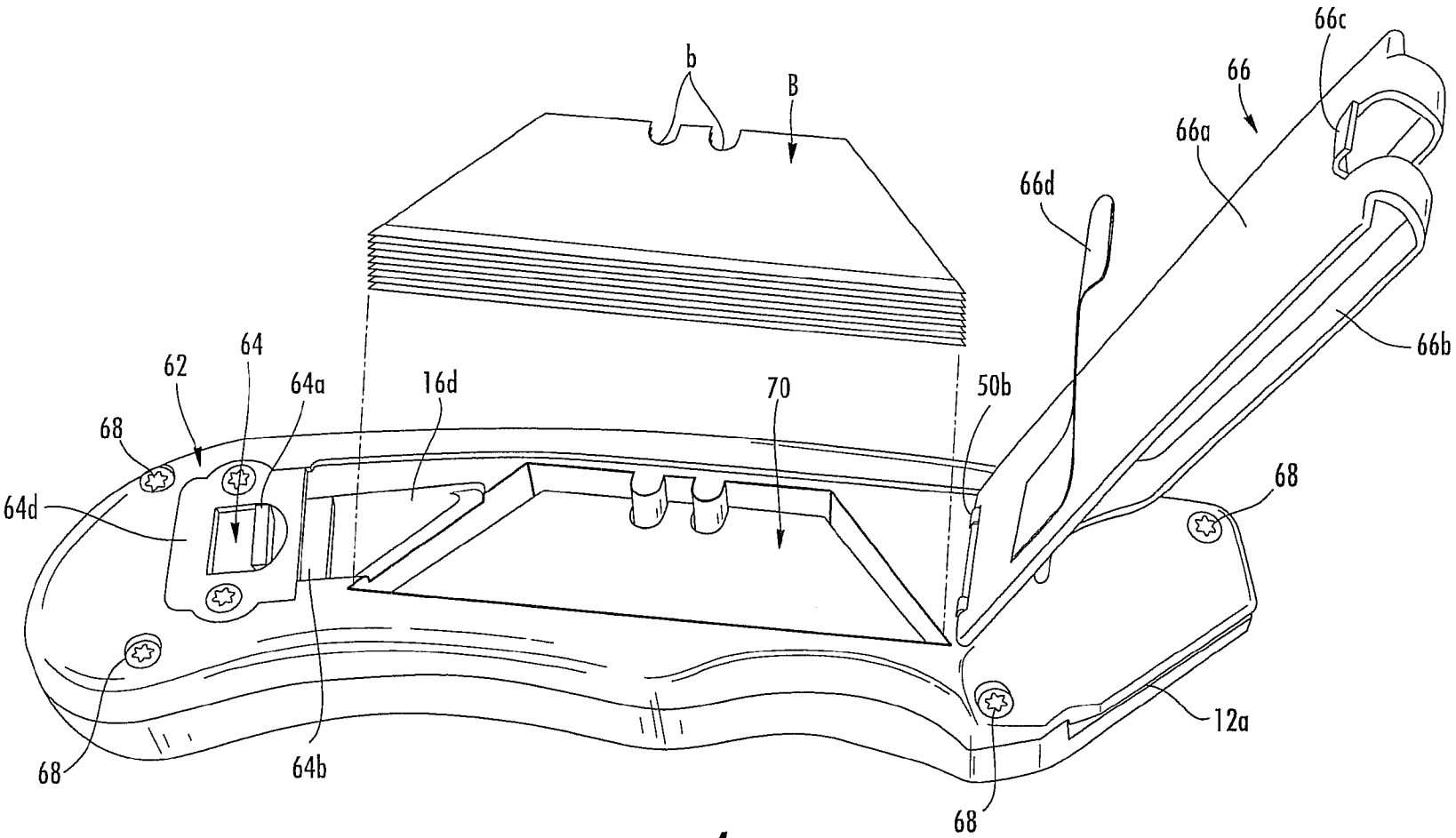
FIG. 4 is a exploded perspective view illustrating the manner in which the clip cover also used to close the blade storage or reservoir is opened for adding additional blades that become available for self loaded when the cover is closed.

The utility knife 10 includes a handle 12 formed of a pair of complementary shells, a right shell 14 and a left shell 16, together forming a substantially enclosed clam shell arrangement having a front aperture 12*a*(FIG. 4). The right shell 14 includes a lock slot 14(*a*). While the upper edge of the right shell 14 is generally smooth and slightly curved as shown there is provided a notch, recess, depression or cut-out 14*b*at the front end of the handle 12, for reasons to be discussed.

Figure 2A:
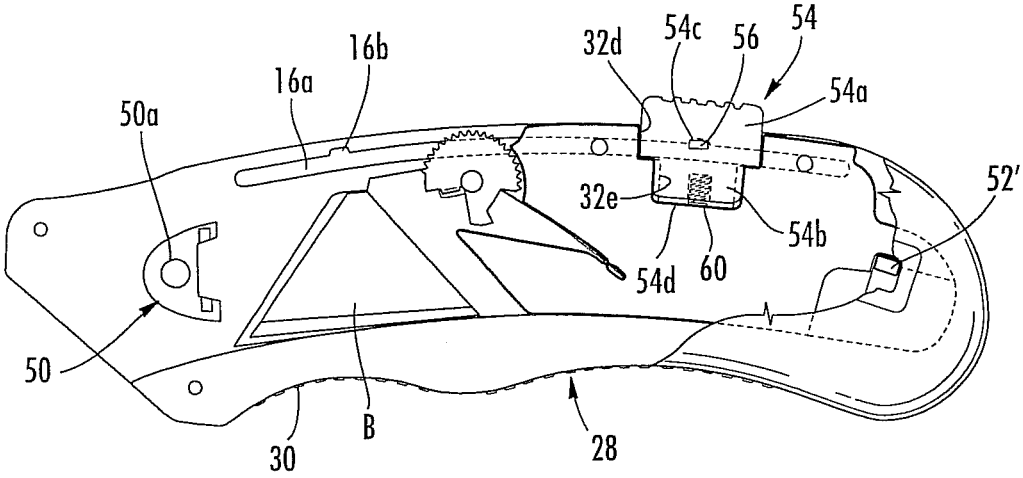
FIG. 2 (A) is a side elevational view of the utility knife showing FIG. 1, showing partially broken way to illustrate the internal carriage and supported blade; the retracted locked position of the carriage.
Figure 2B:
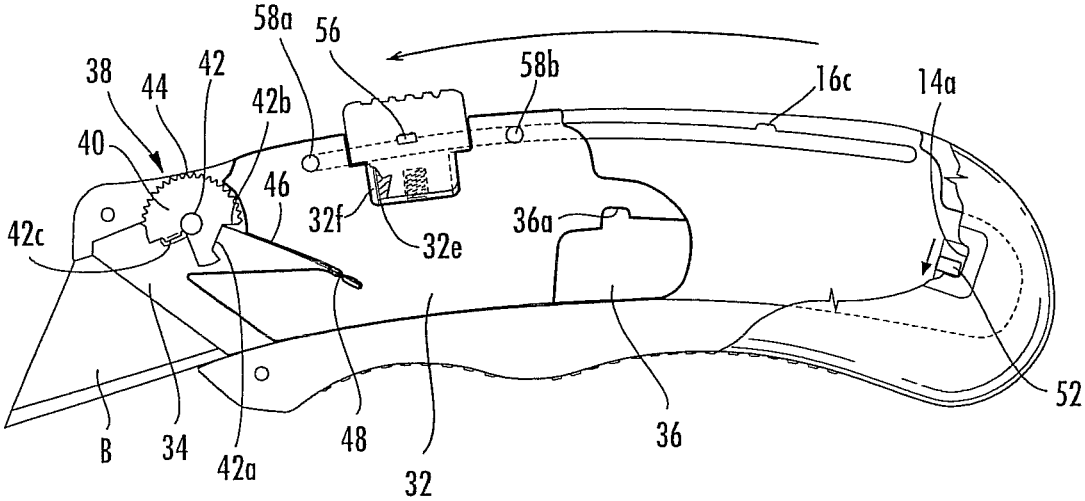

The left shell 16 is provided with an elongate recess 16*a* (*Figs*. 2A, 2B) that generally extends from the rear end of the handle to the right end as shown and generally follows the curvature of the upper edge portion of the handle. A complementary or similar elongate recess is also provided in the right shell 14 (not shown) so that both of the associated elongated recesses generally follow each other and are parallel along the internal facing surfaces of the respective right and left shells. Each of the elongate recesses 16*a*includes a front notch 16*b* (FIG. 2B) and a rear notch 16*c* (FIG. 2B). The left shell 16 is also provided with a recess 16*d* sufficiently in deep to receive a locking mechanism to be described.

The left shell 16 is provided with a generally flat upper edge 18 while the right shell 14 is provided with a cut-out 20 defining a rear edge 22 and a front edge 24, the cut-out 20 forming and defining a slot 26 extending between the rear and front edges 22, 24. The lower edge 28 of the handle is shown provided with a curvature to provide an ergonomic or comfortable feel when the handle 12 is held. Ribs 30 may be provided along the lower edge 28 to provide a better grip on the handle and to prevent slippage.

Figures 3A, 3B:
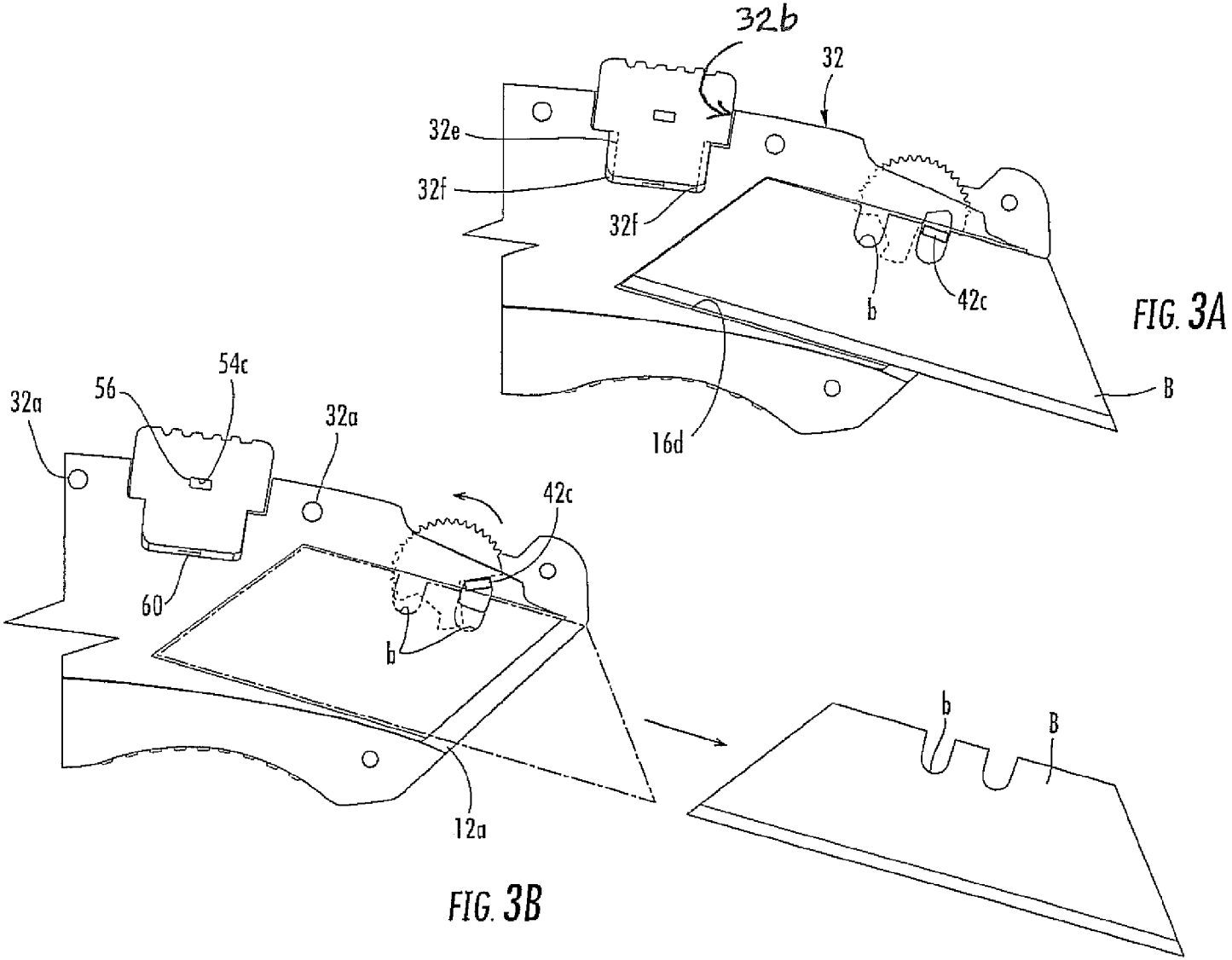
FIG. 3 (A) is a fragmented view of the reverse side of the carriage shown in FIG. 2(A) and FIG. 2(B), illustrating the tab which is integrally formed with the blade release disc in the manner in which it engages a notch in a blade.

Within the handle 12 there is provided a carriage or blade holder 32 that includes holes 32*a*that are spaced from each other as shown in FIGS. 3A, 3B. A generally U-shaped cut-out 32*b*is provided in the upper region of the carriage between the holes 32*a*, having a lower narrow portion 32*e*and a upper wider portion 32*d*.

The carriage 32 is provided with a front recessed region 34 that is recessed to a depth that substantially corresponds to the quick release disc to be described. A rear recessed region 36 is provided in the carriage (FIG. 2B) that includes an upperwardly extending notch 36*a*. Mounted on the carriage 32 is a blade release mechanism 38 that includes a generally circular disc 40. Referring, for example, to FIGS. 2A, 2B, the disc 40 is actually shown as a partial disc, approximately a semicircle with an indentation or cu-out 42*a* that defines a bearing edge 42*b*. A tab 42*c* extends normal to the plane of the disc, extending through aperture 42*d* to project these partially beyond the opposing face or surface of the carriage. A rivet 42 supports the disc in rotatable relationship to the carriage so that disc 40 can rotate between locking and releasing positions, as being described. The disc 40 is also preferably provided with teeth or other serrations 44 on the upper or exposed circular portion of the disc to facilitate gripping with the thumb or the finger of the user.

Referring to FIGS. 2A and 2B, a leaf spring 46 has two opposing free ends, one of which is secured to the carriage by any suitable attachment means 48 while the other end extends into the region of the cut-out 42*a* and approximate to the bearing surface 42*b* of the cut-out. Leaf spring 46 has a thickness equal to or less than the depth of the front recessed region 34 so as to not to protrude beyond the face of the carriage or in any way interfere with the movements of the carriage within the handle. The leaf spring 46 is so configured and biased so that it normally abuts against the bearing edge 42*b* and causes the disc 40 to rotate to the extreme counterclockwise position, as unit FIG.2B, the motion being limited when the tab 42*c* engages one of the aperture 42*d* within the carriage. This extreme counterclockwise position of the disc 40 corresponds to the locking position of the blade release mechanism 38 when the tab 42*c* is in its lowermost position towards the Blade. Referring to FIG. 3A, this is a view of the reverse side of the carriage, indicating the position of the tab 42*c*, its lowermost position, corresponding to a extreme clockwise direction of the disc as unit FIG. 3A. In this condition, the locking tab 42*c* is received within a notch b of the Blade to prevent the blade from moving within its own plane relative to the carriage. When the disc 40 is rotated in a clockwise direction (as viewed in FIGS. 2A, 2B) or in a counterclockwise direction (as viewed in FIGS. 3A, 3B), the tab 42*c* is lifted out of the notch b, as shown in FIG. 3B, thereby releasing the Blade through the front aperture 12*a*. The position of the disc 40 in FIG. 40*b*, therefore corresponds to the blade releasing position. The disc 40 is positioned to be accessible to the user by placement of the thumb of the user's hand that also holds the utility knife handle 12.

The specific means 48 for attaching the spring is not critical for purposes of the invention and any suitable means may be used, including press fitting within a narrow slot, welding, bonding, and the like.

Provided on the inside surface of the right shelf 14 is a recessed hinged support 50 for a blade replacement cover, to be described. The hinge support includes a suitable fastener 50*a* and a hinge 50*b*. The hinge support 50 is recessed below the inside surface of the left shell 16, the hinge 50*b* extending through the left shell and being accessible to the reverse or exterior side of the left shell 16 as best shown in FIG. 4.

Extending through the lock slot 14*a*, and the rear of the right shell 14 is a carriage lock toggle 52 accessible from the exterior from the handle formed with a locking tab 52 projecting into the carriage and dimensioned to be selectively received within the notch 36*a* of the rear recessed 36 of the carriage. Lock 52' as dimensioned to be received within the notch 36*a* when the toggle 52 is manually lifted or moved upwardly to the position shown 2A. Being received the notch 36*a*, the locking tab 52' enters the notch 36*a* and prevents the carriage from moving forwardly, as suggested in FIG. 2A. Only when the lock toggle 52 is moved downwardly, as shown in FIG. 2B, does the locking tab 52' move out of the notch 36*a*, this allowing the carriage to move towards the front of the handle as shown in FIG. 2B. Suitable spring loading or other frictional or other means may be used to maintain the carriage lock toggle 52 in place once moved to the locking or unlocking positions so that it remains in the selected position and can only be moved to the alternate or other position when sufficient manual force is applied to the toggle 52 to move it as desired.

A release button 54 generally has a T-shaped configuration, as viewed from the side, and has a generally uniform thickness as viewed from the top. The release 54 includes a wide upper portion 54*a* and a narrow lower portion 54*b*. Formed within the wider portion 54*a* is a transverse slot 54*c* that extends through the entire thickness of the release button. A transverse bar 56 is dimensioned to be received within the transverse slot 54*c* with some clearance so that it can be readily asserted through the transverse slot. While the transverse bar is shown to be generally rectangular, in the presently preferred embodiment, other shapes can be used including, for example, square. The length of the transverse bar 56 is selected to have both three ends of the bar receivable within opposing elongate recesses 16*a*, both the right and left shells 14, 16. The transverse 56 is also configured and dimensioned to correspond to the front and rear notches 16*b*, 16*c* so that the transverse bar can also be received within those notches.

Alignment pins 58*a*, 58*b* are dimensioned to be receivable within the holes 32*a* in the carriage. Again, the specific cross-sectioned configurations of the pins 58*a*, 58*b* is not critical as long as they can be received within the elongate recesses 16*a* on both of the right and left shells 14, 16. The lengths of the alignment pins 58*a*, 58*b* are, therefore, substantially the same lengths as the transverse bar 58. The alignment pins 58*a*, 58*b* are preferably configured to prevent entry into a locking engagement with the notches 16*b*, 16*c*, the alignment pins having the sole functional purpose to maintain the carriage in the desired orientation and prevent it from excessively rotating in relation to the handle. The alignment pins 58*a*, 58*b* do not however, have any locking function but only to maintain the carriage and a desired aligned orientation.

The release button 54 is provided, on the narrow portion 54*b* with a downwardly open bore 54*b* dimension for receiving a helical compression spring 60 to normally urge the release button 54 to move upwardly in relation to the carriage. The release button 54*b* is, accordingly, moveably mounted relative to the carriage for limited upward and downward movements within the correspondingly shaped upper opening in the carriage. To maintain the release button 54 within the plane of the carriage any suitable may used. In the presently preferred embodiment, generally transverse movements of the release button 54 in relation to the carriage is prevented by providing recesses 32*e* on forward and opposing edges 32*e* along the narrow portion 54*b* of the release button, while correspondingly dimensioned ribs 32*f* are provided on the carriage so that the ribs 32*f* can be slidingly received within the recesses 32*e* with some clearance so that the release button 54 can freely move upwardly and downwardly but not transversely in relation to the carriage.

Referring to FIG. 4, the cover lock 62 includes a slide number 64 having an outwardly extending finger grip 64*a* accessible to a user from the outside of the handle and an inwardly extending latch extending latch 64*b*. Any suitable spring or other biasing means may be used to normally urge the finger grip 64*a* and latch 64*b* towards the front of the housing or aperture 12*a*. By manually gripping the finger grip 64*a* and applying a rearward force to it the entire latch 64*b* can be retracted below the cover plate 64*d*(FIG. 4).

A cover 66 serves a couple of different functions. The cover 66 includes a generally flat plate 66a that is hingedly connected to the hinge 50*b*.On the exterior side of the plate 66*a* a spring clip 66*b* is inwardly formed therewith and configured to slide over a retaining member such as a belt. Extending inwardly to the opposite side of the location of the clip 66*b*, is a locking tab 66*c* positioned and configured to clear the cover plate 64*d* and enter into the recess 16*d* when the slide 64 is fully retracted against the action of a spring or other biased member. Once the tab 66*c* is below the cover plate 64*d* and the slide 64 is released the latch 64*b* moves into a position above the tab 66*c* to lock it and prevent the cover 66 from opening. However, when the finger grip 64*a* is moved rearwardly, as viewed in FIG. 4, the latch 64*b* moves below the cover plate 64*d*, thereby releasing the tab 66*c*. A leaf spring 66*d* is mounted in any suitable manner on the plate 66*a* as shown in FIG. 4, being arranged to apply an inwardly-directed force on a stack of blades that are received within the blade compartment 70 formed within the left shell 16. It will be appreciated that the leaf spring 66*d* urges one or more blades along a direction transverse to the length direction of the handle or axis of the tool to be urged inwardly in the direction of the carriage 32 disposed on the other side of or juxtaposed or in registry with the blade compartment 70.

The operation of the utility knife 10 will now described. Initially, the finger grip 64*a* is manually urged towards the rear of the handle 12 to release the tab 66 as described. The clip cover 66 can now be pivoted about the hinge 50*b* to the fully opened position as shown in FIG. 4. The stack of Blades can now be inserted into the blade compartment 70. In the presently preferred embodiment conventional trapezoidal Blades with two spaced notches b as shown are used. However, it will be evident to those skilled in the art that differently shaped blades can be used and the blade compartment 70 and the carriage suitably modified to accommodate differently shaped blades with different degrees of advantage. Once the blades are inserted within the compartment 70, the finger grip 64*a* is moved towards the rear of the handle 12 to move the latch 64*b* into a fully retracted condition below the cover plate 64*d*. The cover plate 66*a* can now be pivoted about the hinge b to a fully closed position and the finger grip 64*a* released to engage the tab 66*c* and lock the cover plate.

When the carriage or blade holder 32 is moved to its fully retracted position to the rear of the handle 12 the recess 16*d* is moved into alignment or in registry with the blade compartment 70 so that the recess 16*d* can receive the rear portion of a blade as suggested in FIG. 3A. Because the recess 16*d* has a depth substantially corresponding to the thickness of the blade at least a corresponding portion of the blade that is received within the recess 16*d* as shown in FIG. 3A. The surface of the blade facing outwardly on the page, as viewed in FIG. 3A is substantially co-extensive with the raised surface of the carriage in which the recess 16*d* is formed, to effectively provide a smooth and continuous surface between the carriage and the blade in a generally conunon plane. The movement of the blade into the recess 16*d* is facilitated by the pressure applied by the leaf spring 66*d* that forces the blade into the compartment 70 towards the carriage and the recess 16*d*.

Figures 5A, 5B, 5C:
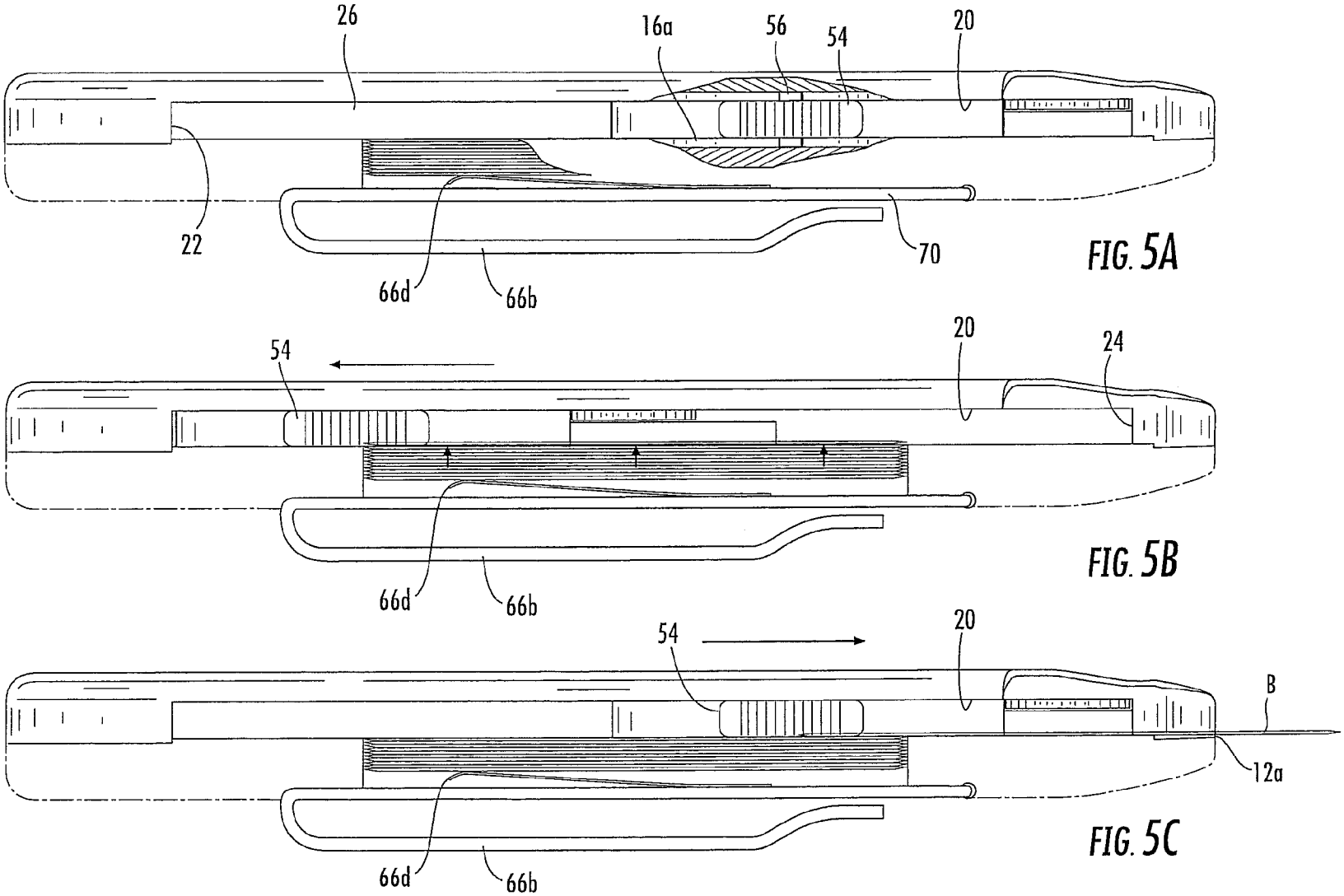
FIG. 5A is a top plan view of the utility knife, partially in cross-section, shown prior to loading of a blade onto the carriage, with the carriage release button in a forward position relative to the handle.
FIG. 5B is similar to FIG. 5A, showing the release button and carriage moved to the rear loading position to accept a blade from the blade compartment.
FIG. 5C is similar to FIGS. 5A and 5B showing the release button and carriage loaded with a blade returned to the forward position to expose the blade forwardly of the handle in its operative position.

Once a blade is received within the recess 16*d* of the left shell, the tab 42*c* is also received within one of the notches b in the blade as shown in FIG. 3A. Since the blade is captured between the carriage and the inner surface of the left shell 16 the blade is immobilized laterally and also longitudinally by the tab 42*c*. To move the carriage from the retracted position shown in FIG. 2A to the extended position shown in FIG. 2B the release button 54 is depressed downwardly against the action of the spring 60. When so depressed, the transverse bar 56 mounted on the release button is moved out of the rear notch 16*c* to unlock the button from the rear position. Application of a forward pressure on the release knob while the button is depressed downwardly allows the transverse bar 56 to slide within the elongated recesses 16*a* until the transverse bar 56 reaches the front notch 16*b*. A release button 54 causes the spring 60 to urge the transverse bar 56 into the notch 16*b* and thereby lock the carriage against longitudinal frontward or rearward movements. In the forward position shown in FIG. 2B the blade is locked and ready to be used. Similarly, to retract the blade the release button 54 is depressed while simultaneously applying a force on the release button in a rearward direction. This releases the transverse bar 56 from the notch 16*b* and allows both the transverse bar 56 as well as the alignment pins 58 to slide through the elongated recesses 16*a* in the two right and left shells, 14, 16. This is also illustrated in FIGS. 5A-5C. In FIG. 5A, the carriage is in a forward position but no blade is exposed because a blade has not yet been lodged onto the carriage. Rearward movement of the release button 54 brings the carriage to the rearmost position in the spring 66*d* urges a blade to be received onto the surface of the carriage and more specifically within the blade recess 16*d*. After a blade is inserted, as suggested by the arrows in FIG. 5B, a further sliding movement of the release button 54 brings the carriage forward and together with it a blade that has now been secured to the carriage.

To release a defective or used blade, the carriage is moved to the forward-most or extended position as shown in FIGS. 1 and 2B. As a result of the disc cut-out 14*b*, the release disc 40 is only accessible or even visible in that extended position. When the carriage is retracted the disc 40 is dimensioned so as not to protrude above the upper edge of the handle. Therefore, when the carriage and blade are retracted the quick release disc 40 is not accessible and cannot be gauged to inadvertently release the blade. However, in the position shown in FIGS. 1 and 2B, 1B, 2B and 3A, a user's thumb of the hand holding the utility knife can contact the disc and pull towards the back causing the disc to rotate in a counterclockwise direction as shown in FIG. 3B. This lifts the tab 42*c* out of a notch of the blade and the blade can be pulled forwardly through the front aperture 12*a*. Now, after the blade is removed, movement of the carriage towards the rear of the handle, as suggested in FIG. 5B, will result in the utility knife automatically reloading and on the blade from the blade compartment 70 as described.

Once the utility knife has been used and is no longer needed the carriage can be retracted to the rear of the handle 12 and the carriage lock toggle can be lifted or raised to the position suggested in FIG. 2A to lock the carriage.

Although the present invention has been described in some detail by way of illustration and example for purposes of clarity and understanding, it will, of course. be understood that various changes and modifications may be made in the form, details, and arrangements of the parts without departing from the scope of the invention set forth in the following claims.

We claim as follows:

1. A self-loading utility knife comprising: an elongate handle having an internal chamber generally defining an axis and an upper edge extending along a predetermined length of said axis, one end of said handle being a remote end formed with a generally flat aperture suitable for the passage of an active blade with clearance and a notch in said upper edge proximate to said flat aperture and the other end of said handle being a proximate end, said generally flat aperture defining a cutting plane extending through said handle along said axis; a blade-holder slidably mounted within said chamber for movements in directions along said axis between an extended position and a retracted position, said blade holder being adapted to secure a single active blade for movement through said aperture when said blade holder is in said extended position; a blade-holder release button generally arranged along said cutting plane and coupled to said blade holder, said release button having an outer portion that is located exteriorly of said handle, said release button being slidingly movable relative to said handle along said predetermined length to cause said blade holder to move to selected positions between said retracted position and said extended position, said handle being provided to one side of said cutting plane with a blade compartment open to said chamber and arranged at a predetermined position along said axis between said remote and proximate ends and generally dimensioned and configured in the shape of said active blade for receiving a plurality of stacked spare blades arranged generally parallel to said cutting plane so that the spare blades in said blade compartment are shifted transversely relative to said axis into said chamber, said blade holder being provided with a recess having a depth no greater than the thickness of one blade and shaped to correspond to at least a portion of a blade closest to said proximate end to allow at least a portion of a single blade to be received in a retaining relationship within said recess to cause the blade received within said recess to follow the movements of said blade holder; an access cover on said handle for selectively opening and closing said blade compartment for insertion or removal of spare blades; biasing means provided on said access cover for biasing blades within said blade compartment inwardly in the direction of said blade holder when said access cover is in its closed position; locking means for selectively maintaining said access cover in closed or open positions; and a blade releasing means on said blade holder wherein when said blade holder is in the extended position the blade releasing means is located in said notch above a portion of the upper edge defined by the notch such that the blade releasing means will release a blade from the blade holder when a user's thumb draws the blade releasing means rearwardly towards the proximate end of the handle, and when the blade holder is in the retracted position the blade releasing means is located entirely below the portion of the upper edge not defined by the notch, said blade holder only receiving a single blade within said recess, said blade holder being movable to a position juxtaposed to said blade compartment when said blade holder is in a predetermined retracted position in registry with said recess, whereby after an active blade has been removed through said flat aperture said biasing means are caused to automatically move a spare blade along a direction transversely to said axis into said recess for movement to an operative position through said flat aperture when said blade holder is moved to said extended position and movement of said blade holder and release of a blade in said extended position can be implemented through a one handed operation.

2. A self-loading utility knife as defined in claim 1, wherein said elongate handle is formed of a pair of clamshells one to each side of said cutting plane.

3. A self-loading utility knife as defined in claim 1, wherein said blade holder release button is positioned along the top of said handle when the utility knife is normally held during use, whereby said blade holder release button can be engaged and actuated by the thumb of the user.

4. A self-loading utility knife as defined in claim 1, wherein said blade release means comprises a disc mounted on said blade holder including an engaging tab receivable in a notch of a blade, said disc being resiliently biased to normally move said engaging tab into said notch for locking the blade to said blade holder.

5. A self-loading utility knife as defined in claim 1, wherein said handle is provided with an inwardly curved region at said remote end to expose said blade releasing means only when said blade holder is in said extended position.

6. A self-loading utility knife as defined in claim 1, further comprising blade holder locking means for selectively locking the position of said blade holder in a plurality of positions between said remote and proximate ends of said handle.

7. A self-loading utility knife as defined in claim 6, wherein said blade holder locking means comprises mating elongate recesses on opposing surfaces of said chamber facing said blade holder, a plurality of upwardly extending pairs of notches associated with each of said elongate recesses, said blade holder release button being provided with a transverse bar dimensioned to be received within said elongate recesses and within said pairs of notches, a spring being provided to normally urge said transverse bar to move upwardly in the direction of said notches, whereby said transverse bar is generally guided through said elongate recesses when said blade holder slides between said extended and retracted positions and locks said blade holder at a position corresponding to said notches into which said transverse bar is received and said blade holder can be unlocked only when said blade release button is depressed manually against the action of the spring to remove said transverse bar from said notches and moved into said elongate recesses.

8. A self-loading utility knife as defined in claim 1, further comprising a belt clip secured to said access cover.

9. A self-loading utility knife as defined in claim 1, further comprising a blade holder safety lock for locking said blade holder to said handle independently of actuation of said blade holder release button.

10. A self-loading utility knife as defined in claim 1, wherein said axis is a curved axis conforming to the shape of said handle.

11. A self-loading utility knife as defined in claim 1, wherein said access cover is generally elongate and is hinged to said handle at one end of said cover and said locking means comprises a spring biased retainer for selectively engaging a tab on said cover.

12. A self-loading utility knife as defined in claim 1, wherein said biasing means comprises a leaf spring.

13. A self-loading utility knife as defined in claim 1, further comprising protuberance means within said blade compartment dimensioned to be received within notches on said stack of spare blades to maintain said blades aligned with said recess as said blades are successively moved closer to said blade holder to assure proper registry with said recess and reliable engagement of a blade transferred from said blade compartment onto said blade holder by being received within said recess.

* * * * *